US010717108B2

(12) United States Patent
Jiang et al.

(10) Patent No.: US 10,717,108 B2
(45) Date of Patent: Jul. 21, 2020

(54) METHODS AND STRUCTURES FOR LIGHT REGULATING COATINGS

(71) Applicant: University of Florida Research Foundation, Inc., Gainesville, FL (US)

(72) Inventors: Peng Jiang, Gainesville, FL (US); Yin Fang, Gainesville, FL (US); Khalid Askar, Gainesville, FL (US)

(73) Assignee: UNIVERSITY OF FLORIDA RESEARCH FOUNDATION, INC., Gainseville, FL (US)

( * ) Notice: Subject to any disclaimer, the term of this patent is extended or adjusted under 35 U.S.C. 154(b) by 116 days.

(21) Appl. No.: 15/489,184

(22) Filed: Apr. 17, 2017

(65) Prior Publication Data

US 2017/0297058 A1 Oct. 19, 2017

Related U.S. Application Data

(63) Continuation-in-part of application No. PCT/US2015/055673, filed on Oct. 15, 2015.

(60) Provisional application No. 62/065,336, filed on Oct. 17, 2014.

(51) Int. Cl.
*B05D 3/12* (2006.01)
*E06B 9/24* (2006.01)

(52) U.S. Cl.
CPC ..... *B05D 3/12* (2013.01); *E06B 9/24* (2013.01); *E06B 2009/2405* (2013.01); *E06B 2009/2417* (2013.01); *E06B 2009/2464* (2013.01)

(58) Field of Classification Search
CPC ..... B05D 3/12; E06B 9/24; E06B 2009/2405; E06B 2009/2417; E06B 2009/2464
USPC ..... 428/327
See application file for complete search history.

(56) References Cited

U.S. PATENT DOCUMENTS

| | | | |
|---|---|---|---|
| 3,671,105 | A | 6/1972 | Williams et al. |
| 4,125,319 | A | 11/1978 | Frank et al. |
| 4,340,479 | A | 7/1982 | Pall |
| 4,781,441 | A | 11/1988 | Kanbe |
| 5,147,716 | A | 9/1992 | Bellus |
| 5,429,743 | A | 7/1995 | Gues et al. |
| 5,641,332 | A | 6/1997 | Faber et al. |
| 5,753,014 | A | 5/1998 | Van Rijn |
| 5,948,470 | A | 9/1999 | Harrison et al. |
| 5,993,661 | A | 11/1999 | Ruckenstein et al. |
| 6,044,981 | A | 4/2000 | Chu et al. |
| 6,531,304 | B1 | 3/2003 | Bonnemann et al. |
| 6,565,763 | B1 | 5/2003 | Asakawa et al. |
| 6,649,255 | B1 | 11/2003 | Fain, Sr. et al. |
| 6,929,764 | B2 | 8/2005 | Jiang et al. |
| 6,958,137 | B2 | 10/2005 | Lee et al. |
| 7,630,589 | B2 | 12/2009 | Kilic et al. |
| 7,691,325 | B2 | 4/2010 | Chopra et al. |
| 7,889,954 | B2 | 2/2011 | Sailor et al. |
| 2003/0031438 | A1 | 2/2003 | Kambe |
| 2004/0131799 | A1 | 7/2004 | Arsenault et al. |
| 2006/0137462 | A1 | 6/2006 | Divigalpitiya et al. |
| 2007/0206270 | A1 | 9/2007 | Tadashi et al. |
| 2008/0006574 | A1 | 1/2008 | Vidya et al. |
| 2008/0027199 | A1 | 1/2008 | Mazurek et al. |
| 2008/0067477 | A1* | 3/2008 | Hayakawa ..... H01B 1/24 252/511 |
| 2008/0185498 | A1 | 8/2008 | Purdy |
| 2008/0233418 | A1* | 9/2008 | Krueger ..... B29C 55/005 428/523 |
| 2008/0309923 | A1 | 12/2008 | Falk |
| 2009/0034051 | A1 | 2/2009 | Arsenault |
| 2010/0051561 | A1 | 3/2010 | Lee |
| 2010/0068168 | A1 | 3/2010 | Song et al. |
| 2010/0150511 | A1 | 6/2010 | Arsenault |
| 2010/0155325 | A1 | 6/2010 | Zhang et al. |
| 2010/0188732 | A1 | 7/2010 | Akashi et al. |
| 2010/0315703 | A1 | 12/2010 | Purdy et al. |
| 2011/0097814 | A1 | 4/2011 | Bommarito et al. |
| 2011/0233476 | A1 | 9/2011 | Arsenault |
| 2011/0255035 | A1 | 10/2011 | Wu |
| 2012/0073388 | A1 | 3/2012 | Chibante |
| 2012/0074612 | A1* | 3/2012 | Scrivens ..... D04H 1/413 264/164 |
| 2012/0262789 | A1 | 10/2012 | Xie |
| 2012/0293802 | A1 | 11/2012 | Ozin et al. |
| 2013/0199995 | A1 | 8/2013 | Jiang et al. |
| 2013/0222881 | A1 | 8/2013 | Aizenberg et al. |

(Continued)

FOREIGN PATENT DOCUMENTS

| | | |
|---|---|---|
| WO | 1998020388 | 5/1998 |
| WO | 2002073699 | 11/2002 |
| WO | 2008060322 | 5/2008 |

OTHER PUBLICATIONS

Song et al., "One-Dimensional Dynamic Compressive Behavior of EPDM Rubber", J. Engg. Matl. Technol.—Trans. ASME, vol. 125, Jul. 2003, pp. 294-301. (Year: 2003).*

(Continued)

*Primary Examiner* — Ling Siu Choi
*Assistant Examiner* — Ronald Grinsted
(74) *Attorney, Agent, or Firm* — Thomas|Horstemeyer, LLP

(57) ABSTRACT

The present disclosure describes various embodiments of a structure for a composite light regulating film, methods of using the composite light regulating film, and for methods of making a composite light regulating film. The composite light regulating film can include particles and an elastomer matrix. The composite film is configured to modify in response to a force.

15 Claims, 9 Drawing Sheets

(56) References Cited

U.S. PATENT DOCUMENTS

| | | | | |
|---|---|---|---|---|
| 2013/0320467 | A1* | 12/2013 | Buchanan | G06F 3/044 257/419 |
| 2014/0106468 | A1 | 4/2014 | Boersma | |
| 2016/0326334 | A1 | 11/2016 | Peng et al. | |
| 2017/0225395 | A1 | 8/2017 | Boydston et al. | |

OTHER PUBLICATIONS

Kim P, et al. "Rational Design of Mechano-Responsive Optical Materials by Fine Tuning the Evolution of Strain-Dependent Wrinkling Patters." Adv. Optical Mater. 2013. DOI: 10.1002/adom.201300034.

Yang S, et al. "Harnessing Surface Wrinkle Patterns in Soft Matter." Adv. Fund. Mater. 2010. vol. 20, pp. 2500-2564.

Chen Y, et al. "Flexible and Tunable Silicon Photonic Circuits on Plastic Substrates." Scientific Reports. 2012. 2(622). DOI: 10.1038/srep00622.

Harrison C, et al. "Sinusoidal Phase Grating Created by a Tunably Buckled Surface." App. Phys. Letters. 2004. vol. 85, No. 18, pp. 4016-4018.

* cited by examiner

METHODS AND STRUCTURES FOR LIGHT REGULATING COATINGS

CLAIM OF PRIORITY TO RELATED APPLICATION

This application is a continuation-in-part of International Patent Application entitled "METHODS AND STRUCTURES FOR LIGHT REGULATING COATINGS", having serial number PCT/US2015/055673, filed Oct. 15, 2015, where the International Patent Application claims priority to U.S. provisional application entitled "METHODS AND STRUCTURES FOR LIGHT REGULATING COATINGS" having Ser. No. 62/065,336, filed on Oct. 17, 2014, all of which are entirely incorporated herein by reference

FEDERAL SPONSORSHIP

This invention was made with Government support under Agreement No. CMMI-1300613 and CMMI-1562861 awarded by the National Science Foundation and Agreement No. NNX14AB07G awarded by NASA. The Government has certain rights in the invention.

BACKGROUND

Commercial and residential buildings may include windows to allow heat and light to pass into the building. However, these windows may let heat escape from the buildings in the winter time while unnecessarily heating up the buildings in the summer time. Shades or drapes may be used to cover the window and help regulate the temperature in the buildings. Alternatively, other expensive and unreliable window technology may be used for the windows in the buildings.

SUMMARY

The present disclosure describes various embodiments of a structure for a composite light regulating film, methods of using the composite light regulating film, and for methods of making a composite light regulating film.

An illustrative embodiment of the present disclosure, among others, includes a structure having: a composite film comprising particles and an elastomer matrix, wherein the particles and the elastomer matrix form a particle layer that is on a top portion of the composite film, wherein the composite film is configured to bend in response to a force (e.g., a mechanical force), wherein bending the composite film toward the particle layer causes the composite film to appear opaque, and wherein bending the composite film away from the particle layer causes the composite film to appear transparent. In an embodiment, the particle can be selected from the group consisting of: a silica particle, a porous silicon particle, a $TiO_2$ particle, a zinc oxide particle, an epoxy resin particle, a silica plate, a porous silica plate, a $TiO_2$ plate, a zinc oxide plate, an epoxy resin plate, a nanoclay, gibbsite particle, Janus nanoparticle, a glass fiber, a silica wire, silica tube, graphene, and a combination thereof. In an embodiment, the elastomer matrix is a polymer selected from the group consisting of: polydimethylsiloxane, polyethylene terephthalate, polyesters, polyacrylate, silicone rubber, polyacrylates, polypropylene oxide rubber, and a combination thereof.

An illustrative embodiment of the present disclosure, among others, includes a structure having: a composite film comprising particles and an elastomer matrix that form a particle layer being a top portion of the composite film, wherein the composite film is configured to modify in response to a force (e.g., mechanical force).

An illustrative embodiment of the present disclosure, among others, includes a method of modifying a characteristic of a structure that includes: applying a force (e.g., a mechanical force) to a composite film comprising particles and an elastomer matrix, wherein the particles and the elastomer matrix form a particle layer that is a top portion of the composite film, and causing the composite film to appear opaque or transparent upon application of the force toward the particle layer or away from the particle layer, respectively.

Other structures, methods, features, and advantages will be, or become, apparent to one with skill in the art upon examination of the following drawings and detailed description. It is intended that all such additional structures, systems, methods, features, and advantages be included within this description, be within the scope of the present disclosure, and be protected by the accompanying claims.

BRIEF DESCRIPTION OF THE DRAWINGS

Many aspects of the disclosed devices and methods can be better understood with reference to the following drawings. The components in the drawings are not necessarily to scale, emphasis instead being placed upon clearly illustrating the relevant principles. Moreover, in the drawings, like reference numerals designate corresponding parts throughout the several views.

DETAILED DESCRIPTION

Figure 1A:
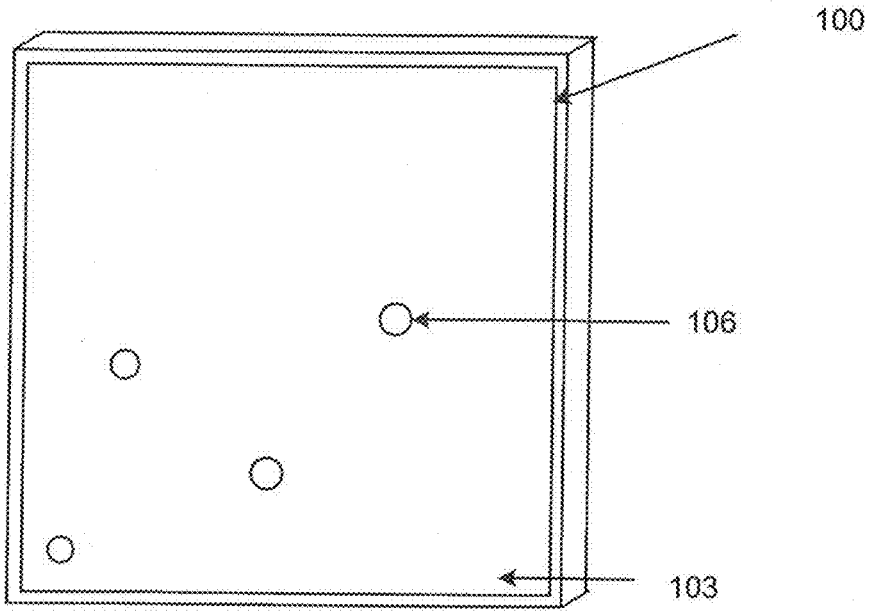
FIG. 1A is a drawing illustrating a composite light regulating film applied to a window where the composite film is configured to be at least partially transparent according to the various embodiments of the disclosure.

Before the present disclosure is described in greater detail, it is to be understood that this disclosure is not limited to particular embodiments described, and as such may, of course, vary. It is also to be understood that the terminology used herein is for the purpose of describing particular embodiments only, and is not intended to be limiting, since the scope of the present disclosure will be limited only by the appended claims.

Where a range of values is provided, it is understood that each intervening value, to the tenth of the unit of the lower limit unless the context clearly dictates otherwise, between the upper and lower limit of that range and any other stated or intervening value in that stated range, is encompassed within the disclosure. The upper and lower limits of these smaller ranges may independently be included in the smaller ranges and are also encompassed within the disclosure, subject to any specifically excluded limit in the stated range. Where the stated range includes one or both of the limits, ranges excluding either or both of those included limits are also included in the disclosure.

Unless defined otherwise, all technical and scientific terms used herein have the same meaning as commonly understood by one of ordinary skill in the art to which this disclosure belongs. Although any methods and materials similar or equivalent to those described herein can also be used in the practice or testing of the present disclosure, the preferred methods and materials are now described.

As will be apparent to those of skill in the art upon reading this disclosure, each of the individual embodiments described and illustrated herein has discrete components and features which may be readily separated from or combined with the features of any of the other several embodiments without departing from the scope or spirit of the present disclosure. Any recited method can be carried out in the order of events recited or in any other order that is logically possible.

Embodiments of the present disclosure will employ, unless otherwise indicated, techniques of chemistry, material science, and the like, which are within the skill of the art.

The following examples are put forth so as to provide those of ordinary skill in the art with a complete disclosure and description of how to perform the methods and use the probes disclosed and claimed herein. Efforts have been made to ensure accuracy with respect to numbers (e.g., amounts, temperature, etc.), but some errors and deviations should be accounted for. Unless indicated otherwise, parts are parts by weight, temperature is in ° C., and pressure is at or near atmospheric. Standard temperature and pressure are defined as 20° C. and 1 atmosphere.

Before the embodiments of the present disclosure are described in detail, it is to be understood that, unless otherwise indicated, the present disclosure is not limited to particular materials, reaction materials, manufacturing processes, or the like, as such can vary. It is also to be understood that the terminology used herein is for purposes of describing particular embodiments only, and is not intended to be limiting. It is also possible in the present disclosure that steps can be executed in different sequence where this is logically possible.

It must be noted that, as used in the specification and the appended claims, the singular forms "a," "an," and "the" include plural referents unless the context clearly dictates otherwise.

DISCUSSION

The present disclosure describes various embodiments of a structure for a composite light regulating film, methods of using the composite light regulating film, and for methods of making a composite light regulating film. The composite light regulating film of the present disclosure has several advantages over other composite films. For example, the current approach does not require stretching or compression of the film to achieve buckling; rather only a small bending force is needed to alter the planar configuration of the film to induce opacity. Without the need for pre-stretching of the material, the elastomer films in the present disclosure provide more cost-efficient manufacturing, improved durability, and the ability to produce larger-area coatings in comparison to other elastomer films.

In one embodiment, the composite film can include particles and an elastomer matrix. In an embodiment, the particles can include: silica particles, porous silicon particles, $TiO_2$ particles, zinc oxide particles, epoxy resins particles, silica plates, porous silicon plates, $TiO_2$ plates, zinc oxide plates, epoxy resins plates, nanoclay, gibbsite particle, Janus nanoparticle, glass fiber, silica wire, silica tube, graphene, or a combination thereof. In an embodiment, the particles can be spherical or semispherical. In an embodiment, the particles or plates can be nanoparticles or nanoplates (e.g., about 5 nm to 500 nm or about 10 nm to 100 nm), microparticles or microplates (e.g., about 500 nm to 10 μm), or the particles can be a mixture of these.

The particles and the elastomer form a particle layer that is the top portion of the composite film. In an embodiment, the particles can be embedded in the elastomer matrix so that a small area or portion (e.g., about 1 to 40%, about 1 to 20%, or about 1 to 10%) of the particles are exposed (e.g., to air or other gas(s)). In an embodiment, a portion of the total number of particles can be fully embedded in the elastomer matrix while another portion of the total number of particles can have an area of the particle exposed and not within the elastomer matrix. In an embodiment, the particles form a two dimensional hexagonal close packed structure to form the particle layer.

In an embodiment, the particles can be disposed onto the elastomer matrix creating the particle layer that is the top portion of the composite film. In an embodiment, "disposed" can include embedding the particles in the elastomer matrix so that a small portion (e.g., about 1 to 40%, about 1 to 20%, or about 1 to 10%) of the particles are exposed (e.g., to air or other gas(s)). In an embodiment, a portion of the total number of particles can be fully embedded in the elastomer matrix while another portion of the total number of particles is disposed in the elastomer matrix.

The composite film can be configured to bend in response to a pre-determined amount of a force such as a mechanical force. The composite film can appear opaque when the film is bent or flexed toward the particle layer (e.g., the particle layer is on the inner side of the curved composite film). The wavelength of the flexed structure is much larger than the wavelength of the incident light, resulting in the light scattering in the visible range. Alternatively, the composite film can appear transparent when the film is bent away from the particle layer (e.g., the particle layer is on the outer side of the curved composite film). In an embodiment, in the composite film can be transparent in the unflexed or neutral position, but the transparency may be less clear than that of the composite film in the flexed position toward the particle layer, in this way the composite film can find appropriate use in the neutral position as well as in varying states of flexure towards or away from the particle layer.

Figure 1B:
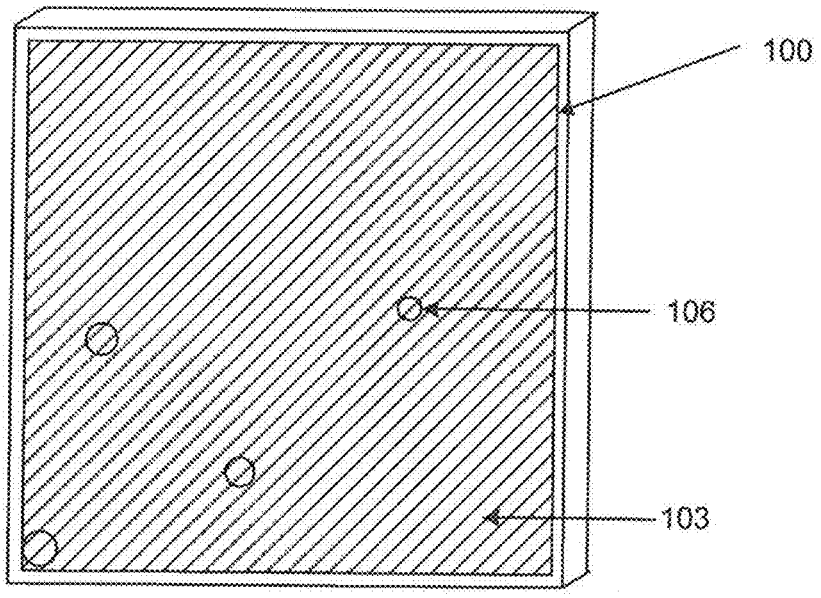
FIG. 1B is a drawing illustrating the composite light regulating film of FIG. 1A where the composite light regulating film is configured to be at least partially opaque according to the various embodiments of the disclosure.

FIG. 1A is a drawing illustrating a composite light regulating film applied to a window where the composite light regulating film is configured to be at least partially transparent according to the various embodiments of the disclosure. FIG. 1B illustrates the composite film 100 of FIG. 1A where the composite film is configured to be at least partially opaque according to the various embodiments of the disclosure. Although other types of particles or combinations of particles can be used, the following discussion illustrates an embodiment where the particles are silica particles. However, in each instance that a silica particle is referred to, another type of particle or mixture of particles could replace or be included with the silica particle, so that the following discussion is not limited to only silica particles.

As shown in FIG. 1A, a composite film 100 can comprise an elastomer matrix 103, a silica particle layer comprising one or more silica particles 106, and/or other components. The thickness of the composite film 100 can be about 10 nm to about 10 millimeters or about 1000 nanometers to about 5 millimeters. Additionally, the composite film 100 can be configured such that application of a force such as a mechanical force can modify the structure of the composite film 100 to change the level of transparency (e.g., nontransparent to transparent or about 0% transparent to 100% transparent) of the composite film 100.

The elastomer matrix 103 can be made of a polymer (e.g., elastomer). In some embodiments, the polymer can be a viscous and/or elastic polymer. The elastomer matrix 103 can additionally be characterized by weak intermolecular forces. Further, the elastomer matrix 103 can have a low tensile modulus and can therefore change shape easily. In some embodiments, the elastomer matrix 103 can have a high failure strain when compared with other materials. In an embodiment, the elastomer can include saturated rubber, unsaturated rubber, 4S elastomers (e.g., thermoplastic elastomer, polysulfide rubber, polyacrylate, elastolefin, and the like), polyethylene terephthalate, polypropylene, polyesters, polyvinyl chloride, polymethyl methacrylate, polydimethylsiloxane, polylactic acid, poly(ε-caprolactone), polyacrylic acid, poly(1,4) butadiene, poly acrylate, polyvinyl acetate, poly ethylene oxide, poly ethylene adipate, polyethylene terephthalate, poly tetrahydrofuran, epoxy, polyurethane, silicon gel, and combinations thereof. In an embodiment, the elastomer can include natural rubber, synthetic rubber, neoprene, butadiene rubber, styrene butadiene rubber, nitrile rubber, hydrogenated nitrile rubber, ethylene-propylene-diene rubber, hypalon, chlorinated polyethylene, polyacrylate rubber, polysulfide rubber, epichalohydrines, urethanes, butyl rubber, ethylene acrylic rubber, fluorocarbon rubber, aflas, silicone rubber, fluorosilicone, polyphosphazene rubber, vestenemer, polypropylene oxide rubber, polynorborene, Royaltherm™, and the like.

The silica particle(s) 106 can be silicon dioxide, or $SiO_2$. In an embodiment, the silica particles are spherical or substantially spherical. In an embodiment, the silica particles 106 can be about 10 nm to 100 microns in diameter, about 0.1 to 10 microns in diameter, about 1 to 10 microns, about 3 to 8 microns, or about 1 micron in diameter. The silica particles 106 can be added to or mixed with (e.g., disposed) the elastomer matrix 103 by injection, spin-on, epitaxial, physical vapor, chemical vapor, and/or other methods of deposition. The silica particles 106 can make up a silica particle layer which can be positioned on the top side of the composite film 100. The silica particles can also be pre-deposited onto a glass substrate through a simple Langmuir-Blodgett (LB) process and the silica particle layer can then be embedded in a polymer matrix by casting the polymer precursors directly on the particles. The density of the silica nanoparticles in the silica particle layer can be about 0.025 to 0.099%. The density can be generally calculated in the following manner: the volume fraction 1 layer of 1 μm or 4 μm particles and polymer matrix is about 76%. The entire thickness is 3 mm, the silica particles occupy about 0.025% to 0.099% of the total polymer matrix. In an embodiment, the volume fraction of the silica particles in the particle layer can be about 65 to 85%, about 70 to 80% or about 76%, where the thickness of the particle layer is about 0.1% as compared to the whole thickness of the structure device.

The composite film 100 can be configured to be modified such that the level of transparency of the composite film 100 varies in response (e.g., 0% transparent to 100% transparent) to a pre-determined amount of force (e.g., mechanical force) applied to the composite film 100. For example, FIG. 1A illustrates the composite film 100 applied to a window such that the transparency level of the composite film 100 can near the transparency level of traditional glass. In this example, the composite film 100 can be configured to be structurally modified by a mechanical force. As illustrated in FIG. 1A, the composite film 100 can be bent away from the silica particle layer, causing the composite film 100 to appear at least partially transparent. In some embodiments, the composite film 100 can appear completely transparent.

The force applied to the composite film 100 can be applied by a computer, machine, person, and/or any other structure configured to apply a force. A pre-determined amount of force can be applied to the composite film 100 to cause structural modification of the composite film 100. The pre-determined amount of force can be about 0.01 Newtons to about 10 Newtons or about 0.1 to about 5 Newtons.

Additionally, the force (e.g., mechanical force(s)) can be applied to the composite film 100 at a single point on the composite film 100, a single end of the composite film 100, multiple ends of the composite film 100, multiple points on the composite film 100, and/or in any other configuration that can cause the composite film 100 to be structurally modified to change the transparency level of the composite film 100. In some embodiments, tensile and/or compression force(s) can be applied to the composite film 100. In some embodiments, the mechanical force(s) can be applied over a composite film 100 having dimensions of about 1 inch by about 1 inch.

The force (e.g., mechanical force(s)) can cause the composite film 100 to be modified such that the composite film 100 can be bent, buckled, curved, rounded, arched, warped, and/or otherwise altered from its typically planar configuration. As can be appreciated, surface buckling can be used to facilitate the wrinkling of a planar surface. In the embodiment illustrated by FIG. 1A, buckling can occur when the composite film 100 can be compressed by the application of the force, which can cause the shape of the composite film 100 to modify at the microscopic level to resemble a waveform. In one embodiment, when buckled such that the composite film 100 can be bent away from the silica particle layer, the silica particles 106 can not scatter visible light as shown in FIG. 1A. In such an embodiment, the silica particles 106 cannot deflect light rays from their surfaces which can cause the composite film 100 to be at least partially transparent. In another embodiment, the silica particles 106 cannot deflect light rays from their surfaces which can cause the composite film 100 to be fully transparent.

FIGS. 1A and 1B illustrate embodiments in which the composite film 100 can be applied to a window. The composite film 100 can alternatively be applied to a variety of surfaces. As non-limiting examples, the composite film 100 can be applied to windows, walls, doors, eyeglasses, drinking glasses, and/or any other surface that can be partially or fully transparent.

For example, the composite film 100 can be applied to windows and can block light transmission which can contribute to a reduction of energy costs. The composite film 100 can also be applied to windows or doors which can provide privacy in residential, commercial, and/or other settings. In the previous examples, the windows or doors can be configured to apply the pre-determined amount of force thereby causing the composite film 100 to become at least partially opaque. The pre-determined amount of force can also cause the composite film 100 to become completely opaque.

As another non-limiting example, the composite film 100 can be applied to the lenses of eyeglasses. In this example, the eyeglasses can be configured to apply the pre-determined amount of mechanical force and can cause the composite film 100 to become at least partially opaque, which can regulate an amount of light that can pass through the eyeglass lenses. The pre-determined amount of force can also cause the composite film 100 to become completely opaque. In this regard, the eyeglasses frame can be configured to apply the pre-determined force to the eyeglasses lenses when a wearer of the eyeglasses steps into the sun. In one embodiment, the eyeglasses frame can automatically apply the pre-determined force to turn the eyeglasses lenses partially opaque when the wearer is in the sunlight. In another embodiment, the wearer of the eyeglasses can manually request the eyeglasses to apply the pre-determined force to turn the eyeglasses lenses partially opaque. In this embodiment, there can be a button or other mechanism on the eyeglasses that the wearer can press which will trigger an application of the pre-determined force upon the eyeglasses lenses, causing the eyeglasses lenses to turn partially opaque.

Figure 2:
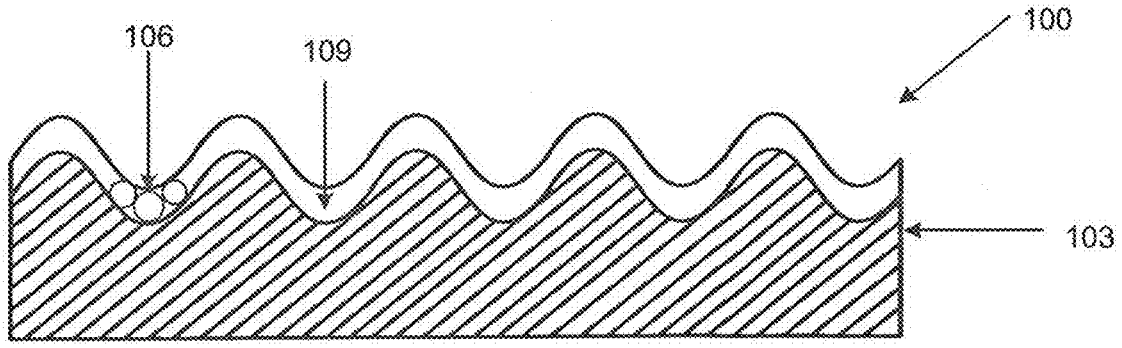
FIG. 2 is a drawing illustrating a simplified cross sectional view of the composite light regulating film of FIG. 1A at a microscopic level according to the various embodiments of the disclosure.

FIG. 2 is a drawing illustrating a simplified cross sectional view of the composite film 100 of FIG. 1A at a microscopic level according to the various embodiments of the disclosure. In particular, FIG. 2 shows a configuration of the composite film 100 that can be modified to be buckled or bent. As shown in FIG. 2, the composite film 100 can comprise the elastomer matrix (e.g., polydimethylsiloxane (PDMS)) 103, the silica particle layer 109 comprised of the one or more silica particles (e.g., having a diameter of about 4 μm) 106, and/or other components. As shown in FIG. 2, the silica particle layer (e.g., a thickness of about 4 μm) 109 can be a top portion of the composite film 100. The thickness of the composite film 100 can generally be in the range of about 1000 nanometers to about 5 millimeters or about 3 mm. Additionally, the composite film 100 can be configured such that applying a mechanical force can modify the structure of the composite film 100 to change the level of transparency of the composite film 100.

The mechanical force(s) can cause the composite film 100 to be modified such that the composite film 100 can be bent, buckled, curved, rounded, arched, warped, and/or otherwise altered from its typically planar configuration. As can be appreciated, buckling can be used to facilitate wrinkling a planar surface. In the embodiment illustrated by FIG. 2, buckling occurs when the composite film 100 can be compressed, causing the shape of the composite film 100 to buckle at the microscopic level to resemble a waveform.

In one embodiment, the composite film 100 can be buckled or flexed such that the composite film 100 can be bent toward the silica particle layer 109. In this embodiment, the silica particles 106 can scatter visible light. That is to say, in this embodiment the silica particles 106 can deflect light rays from their surfaces which can cause the composite film 100 to be visible and thus at least partially opaque and/or completely opaque.

In another embodiment, the composite film 100 can be buckled or flexed such that the composite film 100 can be bent away from the silica particle layer 109. In this embodiment, the silica particles 106 cannot scatter visible light. That is to say, in this embodiment the silica particles 106 cannot deflect light rays from their surfaces which can cause the composite film 100 to be at least partially transparent and/or completely transparent.

Figure 3:
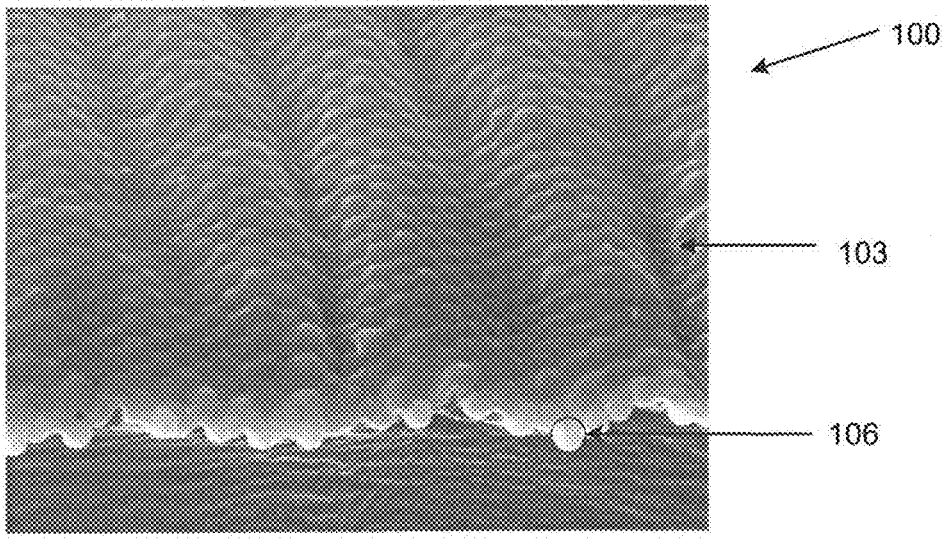
FIG. 3 is a side-view scanning electron microscope (SEM) image of the composite light regulating film of FIG. 1A at a microscopic level according to the various embodiments of the disclosure.

In another non-limiting embodiment, the composite film further comprises a hard polymer layer, wherein the hard polymer layer can include hard particles and platelet fillers. In an embodiment, the hard particles can be selected from a group including, but not limited to: a silica particle, a porous silicon particle, a $TiO_2$ particle, a zinc oxide particle, an epoxy resin particle, a silica plate, a porous silica plate, a $TiO_2$ plate, a zinc oxide plate, an epoxy resin plate, a nanoclay, gibbsite particle, Janus nanoparticle, a glass fiber, a silica wire, silica tube, graphene, and a combination thereof. In an embodiment, the hard polymer layer can be used to alter the characteristic of the structure. For example, the hard polymer layer may be designed so that it is opaque or semi-transparent in the neutral position, while in a flexed position takes on the level of transparency or opaqueness of the composite film FIG. 3 illustrates a photograph of the composite film 100 of FIG. 1A at a microscopic level according to the various embodiments of the disclosure. In particular, FIG. 3 shows a microscopic level photograph of the composite film 100 that has been modified by applied a small bending force.

Figure 4:
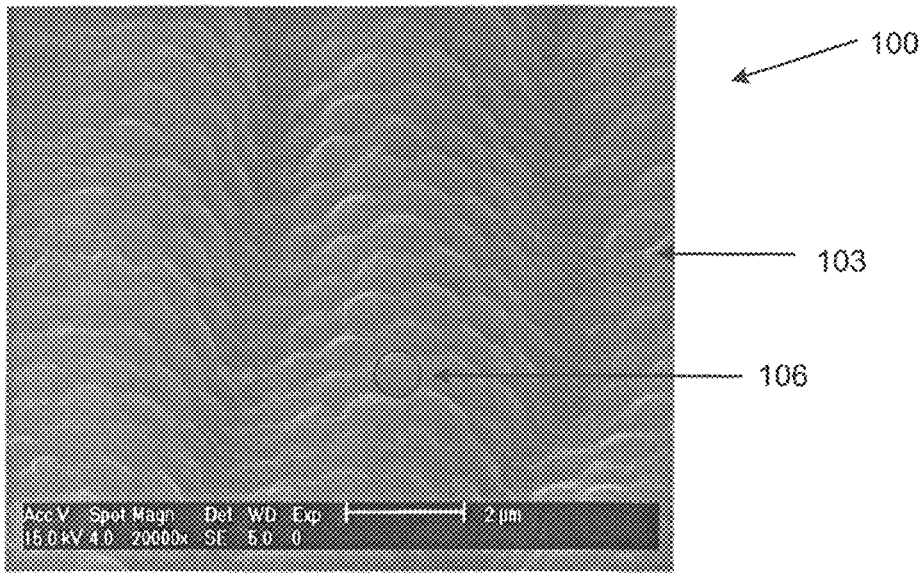
FIG. 4 is a magnified side-view SEM image of the composite light regulating film of FIG. 1A at a microscopic level according to the various embodiments of the disclosure.

FIG. 4 illustrates a substantially top view of the composite film 100 of FIG. 1A at a microscopic level according to the various embodiments of the disclosure. Specifically, FIG. 4 shows a microscopic level photograph of a substantially top view of the composite film 100 that has been modified.

Figure 5:
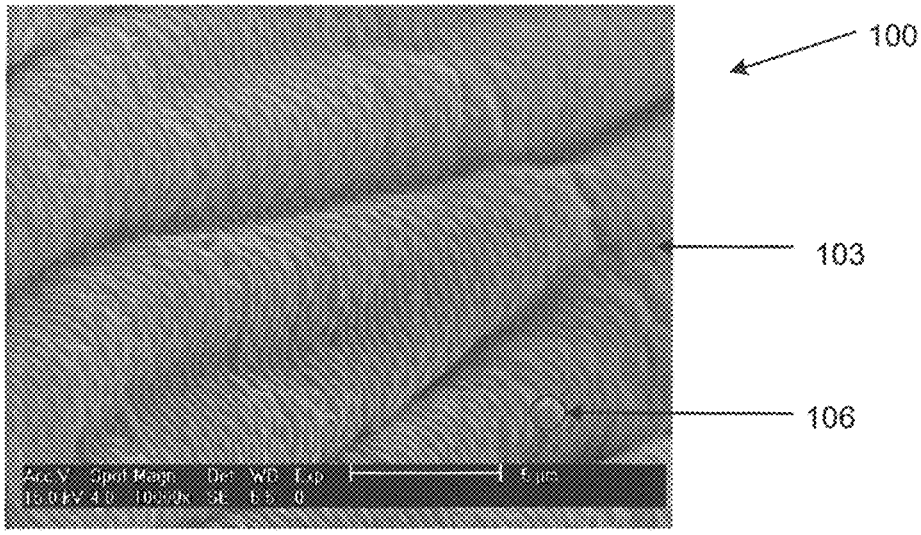
FIG. 5 is another side-view SEM image of the composite light regulating film of FIG. 1A at a microscopic level according to the various embodiments of the disclosure.

FIG. 5 illustrates a side view of the composite film 100 of FIG. 1A at a microscopic level according to the various embodiments of the disclosure. Specifically, FIG. 5 shows a microscopic level photograph of a side view of the composite film 100 that has been modified.

Figure 6:
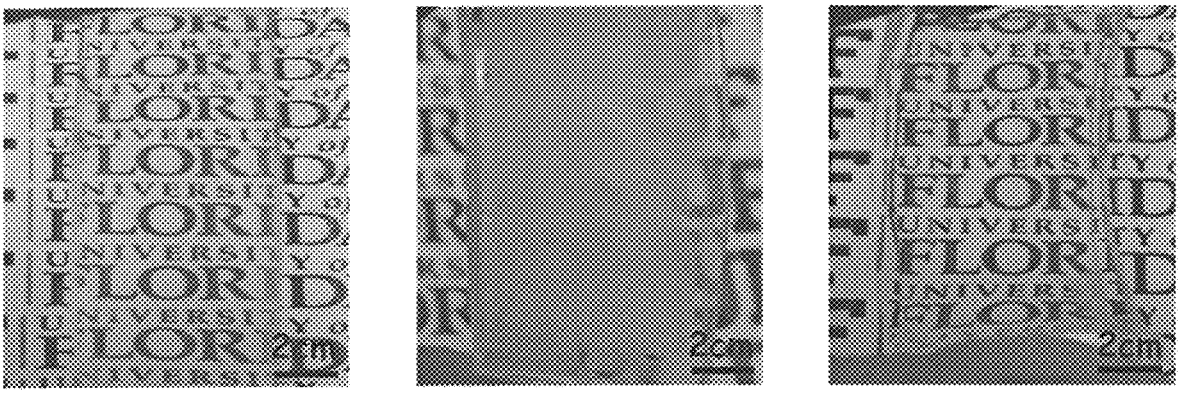
FIG. 6 illustrates an embodiment of the present disclosure showing three transitions: flat piece (left, transparent), bending to the particle coated side (middle, opaque), and bending to the side opposite the particle coated side (right, more transparent, more antireflection).

FIG. 6 illustrates an embodiment of the present disclosure showing three transitions: flat piece (left, transparent), bending to the particle coated side (middle, opaque), and bending to the side opposite the particle coated side (right, more transparent, more antireflection).

EXAMPLES

Now having described the embodiments of the disclosure, in general, the examples describe some additional embodiments. While embodiments of the present disclosure are described in connection with the example and the corresponding text and figures, there is no intent to limit embodiments of the disclosure to these descriptions. On the contrary, the intent is to cover all alternatives, modifications, and equivalents included within the spirit and scope of embodiments of the present disclosure.

Example 1

Introduction

The Nation's 113 million households and over 4.7 million commercial buildings consume approximately 39.7 quadrillion British Thermal Units (Btu's) of energy (quads) annually, about 40 percent of the U.S. total, making the building sector the largest energy consumer.[1] A building's envelope (walls, roofs, and foundations) and windows typically account for 36 percent of overall energy use, or about 14.3 quads in residential and commercial buildings combined, at an annual cost of $133 Billion. Windows are typically regarded as a less energy efficient building component.[2] They contribute about 30 percent of overall heating and cooling loads with an annual impact of about 4.4 quads and there is the potential to reduce lighting impact by 1 quad through daylighting.[1] Smart windows that can regulate the transmission of some (or all) wavelengths of light by changing between a translucent and a transparent state can greatly reduce the costs on heating, cooling, and daylighting, highly promising for next-generation net-zero energy buildings.[3]

A number of cutting-edge smart window technologies, such as electrochromics, suspended particle displays, polymer dispersed liquid crystals (PDLCs), thermochromics, and photochromics, have been developed to change optical properties such as the solar factor and the transmission of radiation in the solar spectrum in response to an external stimulus (e.g., voltage or heat).[4-13] Unfortunately, current state-of-the-art smart windows suffer from two major drawbacks. First and foremost, transparent conductors with high optical transparency and low electronic resistivity for large areas are ubiquitously required for all electrically activated smart windows including electrochromics,[9,14] suspended particle displays,[15] and PDLCs,[16] which are mostly studied and employed due to their active characteristics (compared with passive thermochromic and photochromic devices). The most widely used transparent conductor is indium tin oxide (ITO);[17] however, the scarcity of indium has greatly bolstered the price of ITO in the past decade and a recent report has even predicted that we could run out of indium in the next 10 years.[4] The costly transparent conductors greatly impede the cost reduction efforts, and the state-of-the-art smart windows cost $50 to $80 per square foot. Next-generation smart windows need to approach a price premium of approximately $5 per square foot above standard insulated glass units (IGUs) in the 2020 timeframe to be market viable.[1] In addition, external electric fields need to be powered on to maintain one of the states (usually the transparent state) of the smart windows.[4] This inevitable electrical power requirement could complicate the designs of the final devices and impact their overall power saving efficiencies. The second drawback of the current smart window technologies is the relatively low light transmittance in the transparent state.[4,9] For instance, a previous work has confirmed the relatively low light transmittance for a PDLC film (<70% for 10 μm thick PDLC film under 35 V voltage and <50% for 20 μm thick film under 50 V) compared with a typical transmittance of ~90-92% for common window glass. The same low light transmission issue is also suffered by electrochromic and suspended-particle smart windows,[4,18] greatly impeding their energy saving efficiencies for daylighting and the customer experience/acceptance of these green technologies.

In this example, described herein are embodiments of transformative smart window technology by applying scientific principles drawn from two disparate fields that do not typically intersect—the mature colloidal self-assembly and polymer buckling techniques.[19-25] This technology is inspired by the basic operating principle of PDLC smart windows—light scattering.[8,16] In PDLC devices, large droplets of liquid crystals (micrometer-scale or even larger) are evenly dispersed in a transparent polymer matrix during the solidification or curing of the polymer. With no applied voltage, the liquid crystals are randomly arranged in the droplets, resulting in scattering of light as it passes through the smart window assembly. This results in the translucent appearance of the "OFF" state. When a voltage is applied to the transparent electrodes, the electric field causes the liquid crystals to align, allowing light to pass through the droplets with reduced scattering and resulting in the "transparent" state. However, the relatively large refractive index contrast between common liquid crystals and polymer matrices leads to inevitable stray light scattering from large liquid crystal droplets even with applied voltage, leading to low light transmittance exhibited by PDLC devices in the "ON" State.[16]

As described herein, large light scattering microstructures that can effectively scatter both visible and NIR light with significant spectral irradiance in the solar spectrum can be created on demand on transparent elastomeric composite films by exploring bending-induced buckling instabilities. One system which can be simple to implement and arguably the most studied buckling system is stiff skin layer attached to a thick elastic foundation, much like the human skin comprising a thin and stiff epidermis layer on a thick and soft dermis.[26] Reduction in the elastic energy due to out-of-plane periodic bending caused by either elastic compression or stretching of materials can lead to buckling of the system when loadings exceed a certain critical value.[24] The corresponding critical buckling wavelength is: $\lambda_{buckling}=2\pi h[(1-\nu_f^2)E_s/3(1-\nu_s^2)E_f]^{1/3}$ (eq. 1),[26] where h is the thickness of the skin layer, $E_s$, $\nu_s$ and $E_f$, $\nu_f$ are the elastic moduli and the Poisson's ratios of the skin and foundation layers, respectively. This equation indicates that the buckling wavelength can depend only on the material properties of the skin and the foundation layers (their Poisson's ratios and elastic moduli) and the thickness of the skin layer, and can be independent of the applied stress and strain. To generate effective light scattering microstructures for the proposed smart windows, the buckling wavelength and amplitude (i.e., optical depth) can be significantly larger than the wavelengths of visible and NIR light in the solar radiation spectrum (up to ~2.5 μm).[8] As the contribution of the Poisson's ratios' terms in eq. 1 to $\lambda_{buckling}$ can usually be small and negligible,[26] h (skin layer thickness) and/or $E_s/E_f$ can be increased to enlarge $\lambda_{buckling}$. However, achieving thick skin layers using materials with high elastic moduli can impose great challenges in fabricating structurally stable bilayer buckling systems for smart windows. The stiff skin layers (e.g., silica thin films, hard polymer layers, etc.) are traditionally deposited on the surfaces of the elastic foundations through various approaches, such as physical/chemical vapor deposition (e.g., sputtering), lamination, spin coating, and plasma modification of the elastic surfaces.[27-32] Unfortunately, for materials with very large $E_s$ (e.g., silica), their large internal stresses and high susceptibility to cracking can affect the deposition of thick skin layers;[26] while for materials with small $E_s$ (e.g., various polymers like PMMA), which can easily form thick films, the limited $E_s/E_f$ ratios and possible delamination of the hard skin layer from the elastic foundation with different thermal expansion coefficients and elastic moduli can impede the light scattering efficiencies and the durability of the final devices.[33] In addition, tensile stresses can be extensively utilized in triggering buckling instabilities in conventional bilayer buckling systems.[20-25] Although in-plane tensile stresses can be easily applied for achieving planar devices,[29] the repetitive pulling and releasing of bilayer films can require large energy consumption, especially during stretching large-area films to reach high strains, and may also significantly impact product service lives caused by material fatigue and stress concentration at defects (e.g., cracks).

To revolve the obstacles of traditional bilayer buckling systems in creating effective light scattering microstructures for the proposed smart windows, a novel approach by integrating buckling instabilities with colloidal self-assembly is described herein. Monolayer silica colloidal crystals assembled by a simple and scalable electrostatics-assisted Langmuir-Blodgett (LB) technology[34] can be embedded in an elastomeric polymer matrix (e.g., polydimethylsiloxane, or PDMS for short) to form a bilayer buckling structure. As the Young's modulus of nonporous silica microspheres (~76 GPa)[35] is significantly higher than that of PDMS (~1 MPa),[36] the close-packed monolayer silica microspheres can greatly enhance the effective modulus of the top skin layer. Importantly, the thickness of this hard skin layer can be easily controlled by adjusting the sizes of the monodispersed silica microspheres ranging from ~100 nm to over 10 μm.[37,38] Due to the refractive index matching between silica microspheres (~1.42) and PDMS (~1.4), the flat bilayer composite film is highly transparent, in sharp contrast to the semi-transparent appearance of PDLCs in the "ON" state. Interestingly, bending of the transparent composite film toward the rigid skin layer results in an instantaneous transition to a translucent state, similar to the "milky white" appearance of the "OFF" state of a PDLC device. Scanning electron microscope (SEM) images confirm the formation of hierarchical buckling microstructures caused by elastic compression of the rigid skin layer.

Results

The feasibility of regulating light transmittance by simply bending an embodiment of monolayer silica colloidal crystal-PDMS composite film is described herein.

Figure 7A:
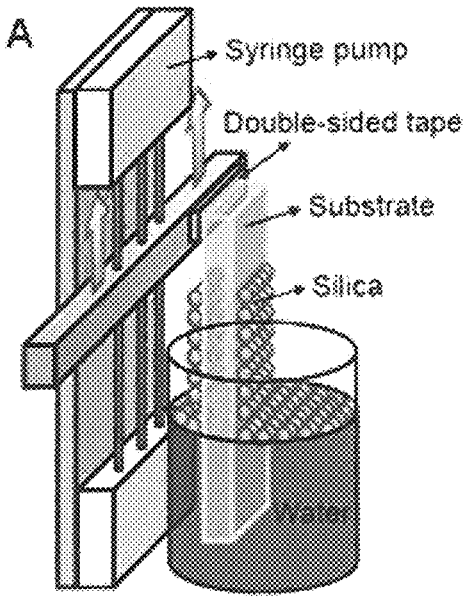
FIG. 7A illustrates a scheme of an embodiment of a Langmuir-Blodgett (LB) assembly process according to the present disclosure.
Figure 7B:
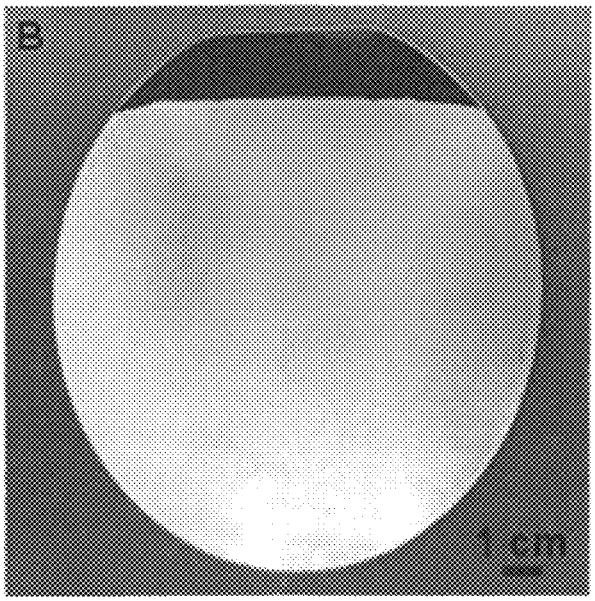
FIG. 7B is a photo of a monolayer colloidal crystal comprising 1 μM silica microspheres.

Langmuir-Blodgett (LB)-Based Colloidal Crystallization:

The LB colloidal assembly technology described herein can be based on the spontaneous crystallization of colloids at an air/water interface induced by strong capillary actions between neighboring floating silica particles, followed by a simplified Langmuir-Blodgett colloidal transfer process, using a setup such as that shown in (FIG. 7A).[34,37] In a typical LB process, a colloidal suspension with 2 vol. % silica microspheres dispersed in ethylene glycol is added dropwise to the surface of water contained in a glass crystallizing dish. The suspension spreads momentarily to form an iridescent monolayer colloidal crystal floating on the water surface. A substrate (e.g., glass or silicon) pre-immersed in water is vertically withdrawn at a rate of ~1.0 mm/min controlled by a syringe pump. The floating monolayer colloidal crystal is conformally transferred onto both surfaces of the substrate. This roll-to-roll compatible bottom-up technique can enable continuous production of large-area monolayer colloidal crystals (such as a 5-in.-sized sample as shown in FIG. 7B), in sharp contrast to common batch processes (e.g., spin-coating) used by most of the currently available colloidal self-assembly technologies.[39-41] Additionally, no sophisticated equipment (e.g. a Langmuir-Blodgett trough) is needed to achieve high crystalline qualities for silica microspheres with a wide range of sizes (from ~100 nm to over 10 μm).[34,37]

Figure 8A:
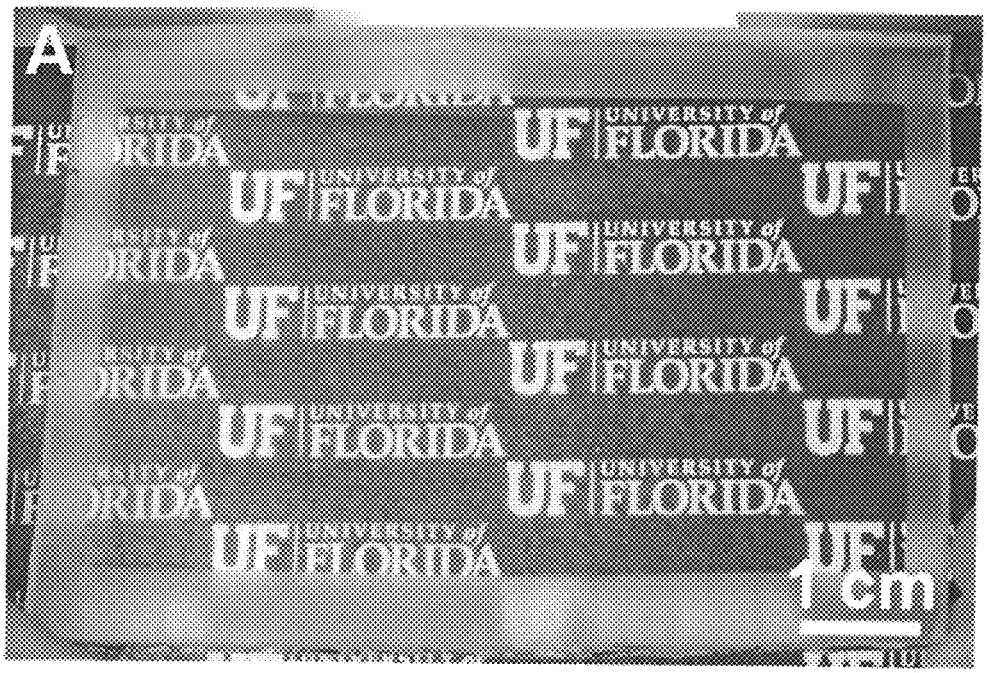
FIGS. 8A-8D shows buckling instabilities induced by bending a monolayer silica colloidal crystal-PDMS composite film can lead to strong light scattering, causing the transparent-to-translucent transition shown in FIGS. 8A-8B.
Figure 8B:
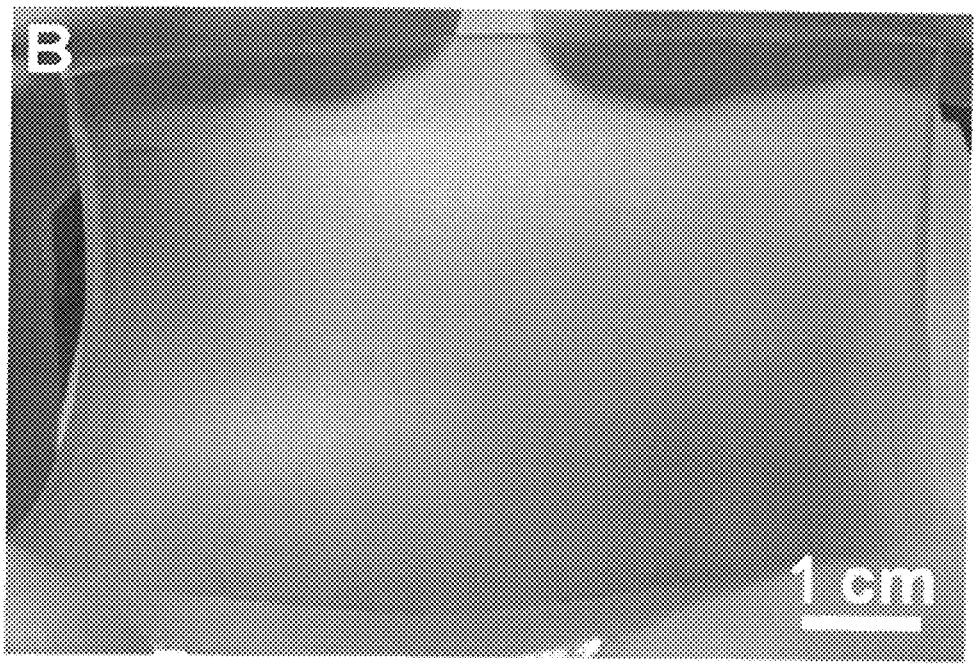
Figure 8C:
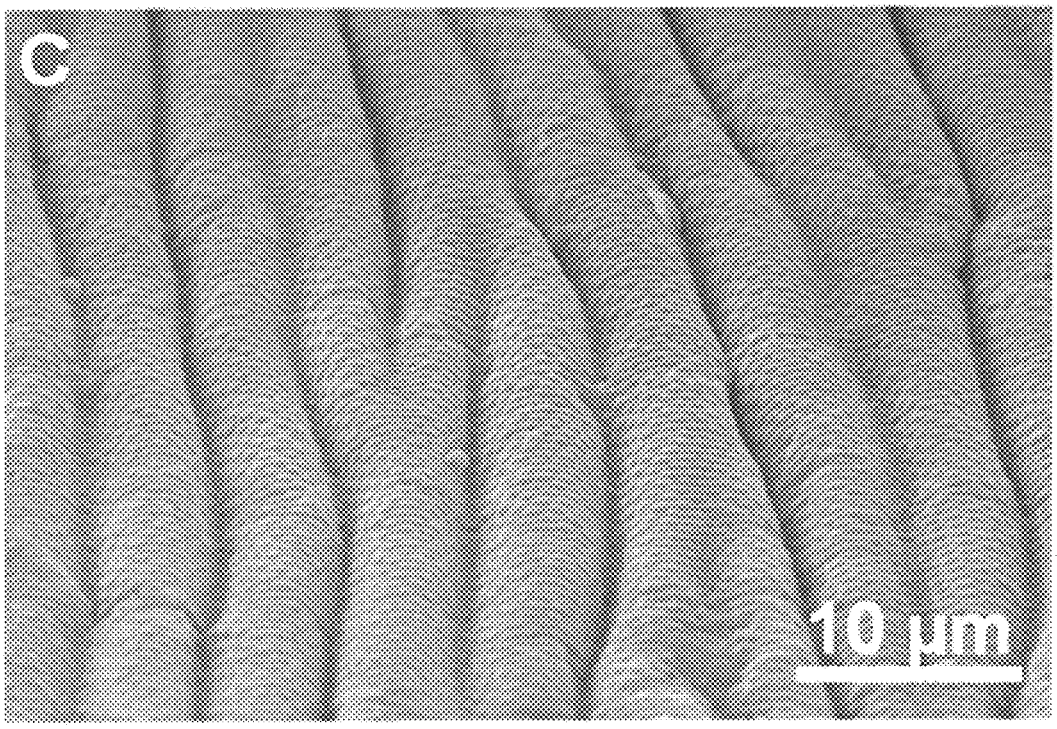
Figure 8D:
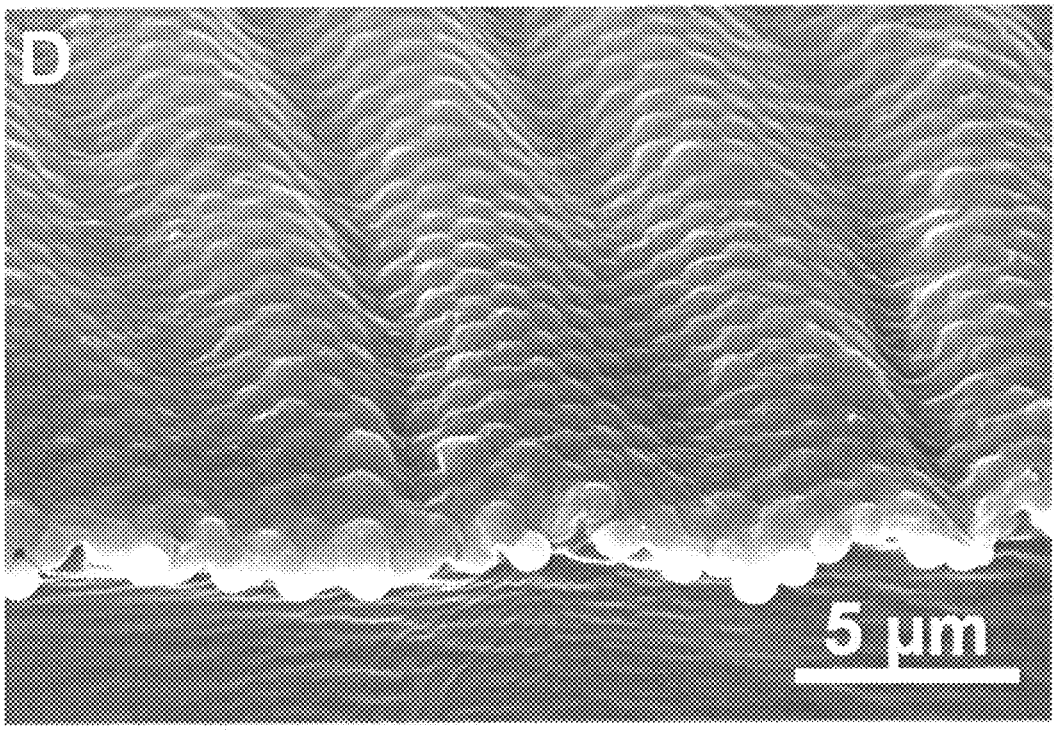
Figure 9A:
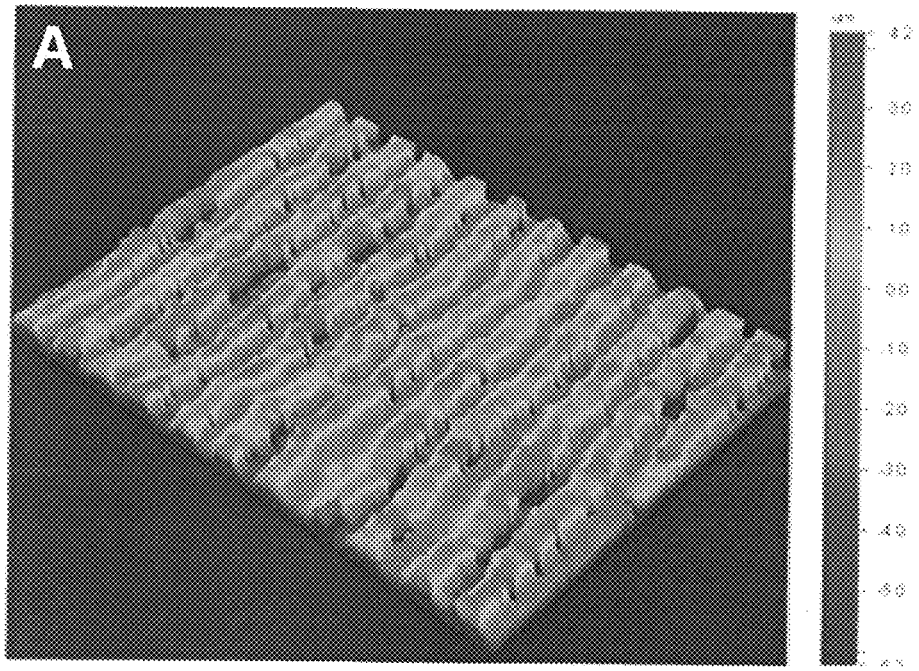
FIG. 9A shows a representative white light interference profilometry image relating to embodiments described herein.
Figure 9B:
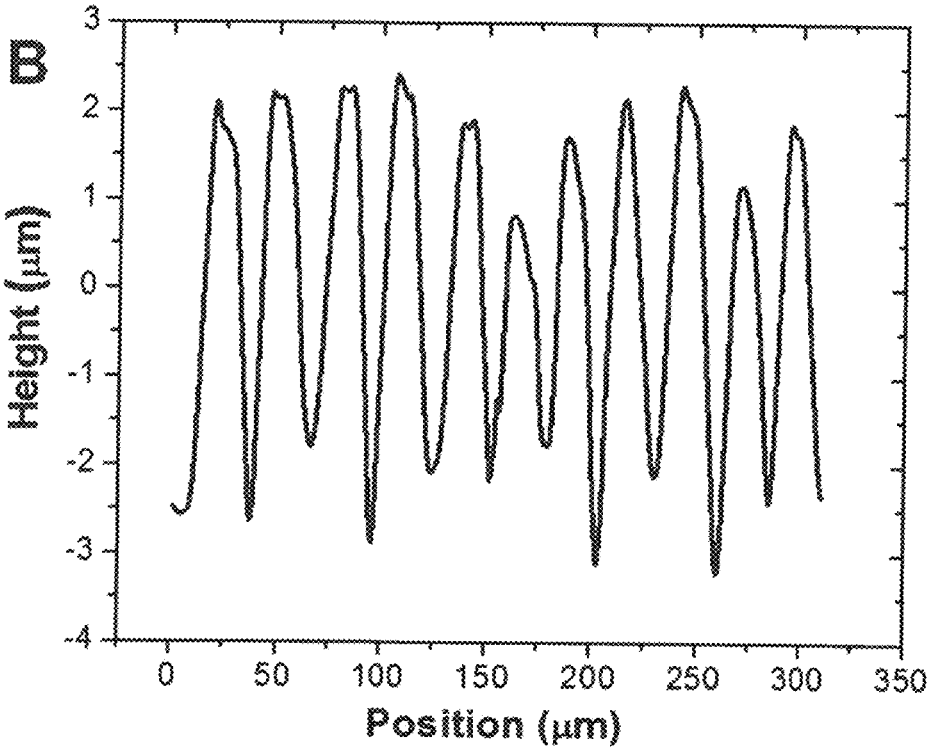
FIG. 9B shows the corresponding height profile of an embodiment of a buckled silica-PDMS composite comprising 4 μm silica microspheres.
Figure 10:
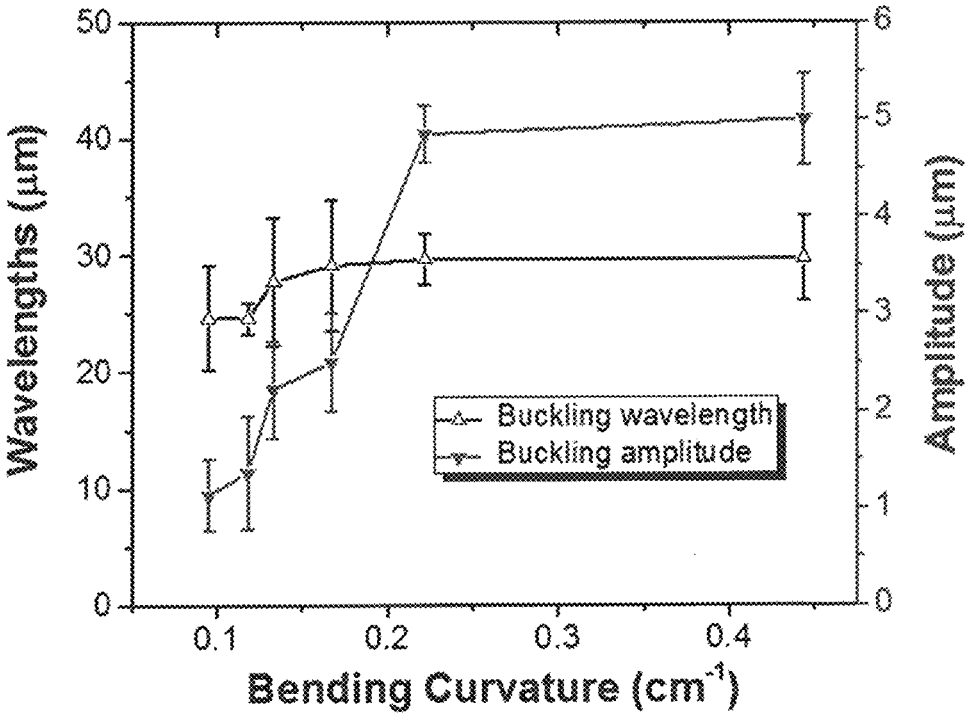
FIG. 10 is a graph illustrating buckling wavelengths and amplitudes of an embodiment of a bilayer composite film comprising 4 μm silica microspheres determined by optical profilometry.

Bending-Induced Buckling Instabilities of Elastomeric Composite Films:

The interstitials between the LB-assembled monolayer silica colloidal crystals are filled with pre-mixed and degassed PDMS precursors (Sylgard 184 from Dow Corning), followed by thermal cure. After peeling the composite film from the substrate, the close-packed silica microspheres are embedded in the PDMS foundation, forming a thin silica-PDMS composite skin layer with the thickness solely determined by the diameter of the colloidal particles. Due to the excellent refractive index matching between silica microspheres and PDMS, the flat composite films (with a typical thickness of 3 mm) are highly transparent (FIG. 8A). Bending of the transparent film toward the rigid skin layer leads to an instantaneous transition to a translucent state (FIG. 8B), caused by strong light scattering from the buckled periodic micro-gratings as confirmed by SEM images (FIG. 2C and FIG. 2D), optical profilometry image (FIG. 9A) and the corresponding height profile (FIG. 9B). In addition, the lattice spacing of the surface-buckled microstructures can also be easily characterized by the optical profilometry. For instance, FIG. 10 shows the measured buckling wavelengths and amplitudes of a bilayer composite film comprising 4 μm silica microspheres versus different bending curvatures. In this disclosure, the bending curvature is defined as the reciprocal of the radius of curvature (R) of the elastomeric composite film (see the scheme shown in the inset of FIG. 11).

Figure 11:
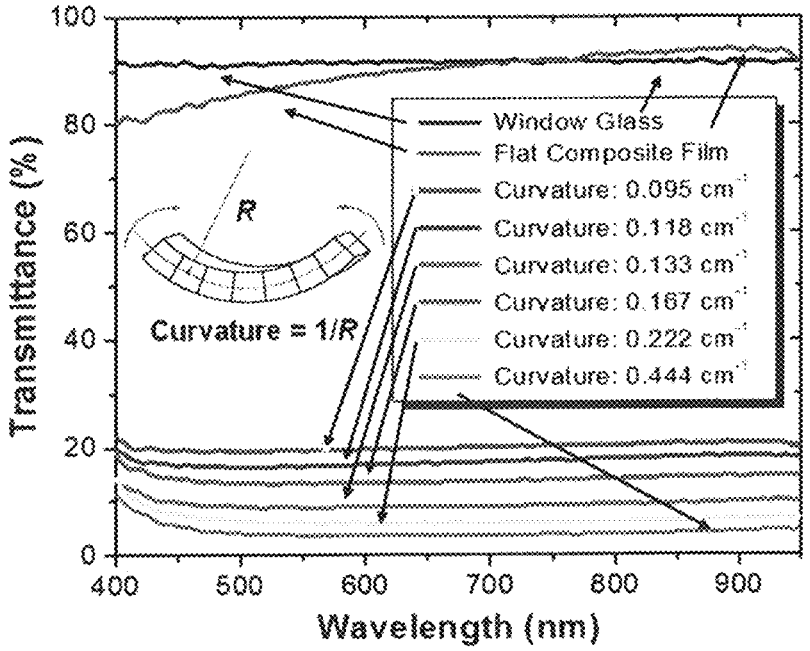
FIG. 11 demonstrates the regulation of light transmittance by bending an embodiment of a composite film comprising 4 μm silica particles to different curvatures.
Figure 12:
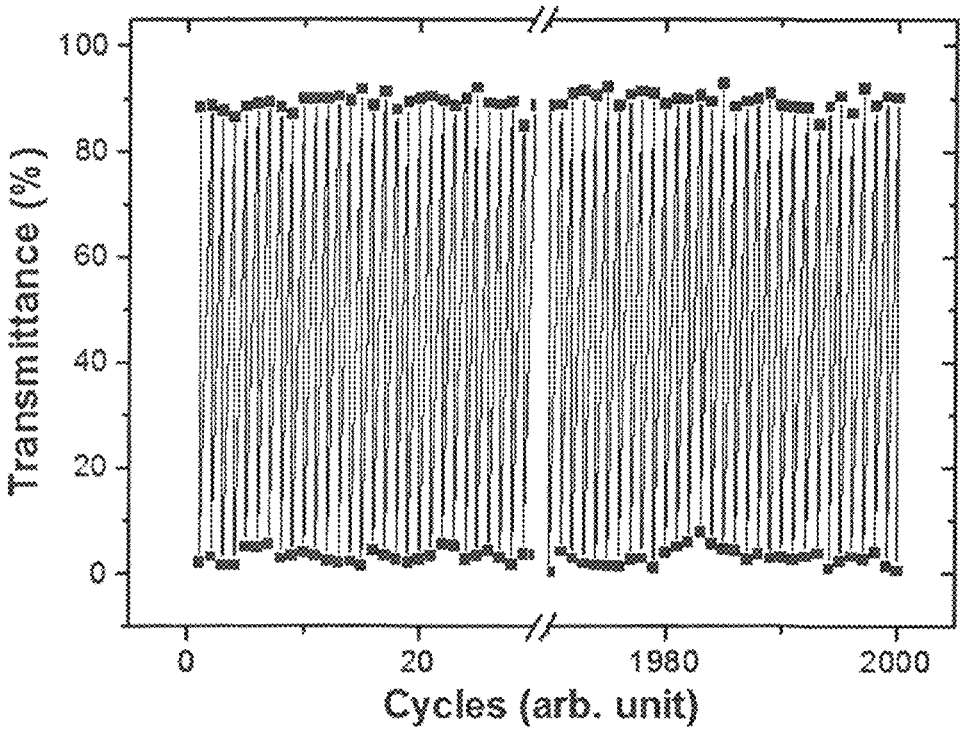
FIG. 12 illustrates light transmittance at 700 nm wavelength measured between the transparent and translucent states of a bilayer composite film comprising 4 μm silica microspheres. The first and last 30 cycles in 2000 cyclic operations are shown.

Regulating Light Transmittance by Bending:

The height profile of the optical profilometry image in FIG. 9B can indicate the formation of periodic gratings with a buckling wavelength of ~28 μm and an amplitude of ~4.5 μm by bending a 7×4 $cm^2$ composite film comprising 4 μm silica microspheres to a curvature of ~0.2 $cm^{-1}$. Importantly, the specular transmission spectra in FIG. 11 show that the transparency of the flat composite film is close to that of a typical window glass; while a small bending curvature (as small as 0.095 $cm^{-1}$) can generate significant transmittance reduction. The translucency could outperform that of traditional smart windows using a larger bending curvature. These experiments and results also reveal that the bending-induced transparency-to-translucency transition can be highly reversible, and the optical performance of the elastomeric composite films does not show any apparent degradation even after 2000 cyclic bending and releasing operations (FIG. 12), indicating high reproducibility and mechanical durability

REFERENCES

1. "2015 Building Energy Data Book", U.S. Department of Energy, Office of Planning, Budget and Analysis, Energy Efficiency and Renewable Energy.

2. Lampert, C. M. Smart Switchable Glazing for Solar Energy and Daylight Control. *Sol. Energy Mater. Sol. Cells* 52, 207-221 (1998).
3. "Building Technologies Office Multi-Year Program Plan 2016", U.S. Department of Energy, Energy Efficiency and Renewable Energy.
4. Baetens, R., Jelle, B. P. & Gustaysen, A. Properties, Requirements and Possibilities of Smart Windows for Dynamic Daylight and Solar Energy Control in Buildings: A State-of-the-Art Review. *Sol. Energy Mater. Sol. Cells* 94, 87-105 (2010).
5. Yang, S., Choi, I. S. & Kamien, R. D. Design of Super-Conformable, Foldable Materials Via Fractal Cuts and Lattice Kirigami. *MRS Bull.* 41, 130-137 (2016).
6. Feng, W., Zou, L. P., Gao, G. H., Wu, G. M., Shen, J. & Li, W. Gasochromic Smart Window: Optical and Thermal Properties, Energy Simulation and Feasibility Analysis. *Sol. Energy Mater. Sol. Cells* 144, 316-323 (2016).
7. Wang, Y., Runnerstrom, E. L. & Milliron, D. J. Ann. Rev. Chem. Biomol. Eng., 283-304 (2016).
8. Park, S. & Lee, S. K. Micro-Optical Pattern-Based Selective Transmission Mechanism. *Appl. Opt.* 55, 2457-2462 (2016).
9. Granqvist, C. G. Recent Progress in Thermochromics and Electrochromics: A Brief Survey. *Thin Solid Films* 614, 90-96 (2016).
10. Smith, G., Gentle, A., Arnold, M. & Cortie, M. Nanophotonics-Enabled Smart Windows, Buildings and Wearables. *Nanophotonics* 5, 55-73 (2016).
11. Granqvist, C. G., Azens, A., Hjelm, A., Kullman, L., Niklasson, G. A., Ronnow, D., Mattsson, M. S., Veszelei, M. & Vaivars, G. Recent Advances in Electrochromics for Smart Windows Applications. *Sol. Energy* 63, 199-216 (1998).
12. Granqvist, C. G., Azens, A., Isidorsson, J., Kharrazi, M., Kullman, L., Lindstrom, T., Niklasson, G. A., Ribbing, C. G., Ronnow, D., Mattsson, M. S. & Veszelei, M. Towards the Smart Window: Progress in Electrochromics. *J. Non-Cryst. Solids* 218, 273-279 (1997).
13. Jelle, B. P., Hynd, A., Gustaysen, A., Arasteh, D., Goudey, H. & Hart, R. Fenestration of Today and Tomorrow: A State-of-the-Art Review and Future Research Opportunities. *Sol. Energy Mater. Sol. Cells* 96, 1-28 (2012).
14. Niklasson, G. A. & Granqvist, C. G. Electrochromics for Smart Windows: Thin Films of Tungsten Oxide and Nickel Oxide, and Devices Based on These. *J. Mater. Chem.* 17, 127-156 (2007).
15. Barrios, D., Vergaz, R., Sanchez-Pena, J. M., Garcia-Camara, B., Granqvist, C. G. & Niklasson, G. A. Simulation of the Thickness Dependence of the Optical Properties of Suspended Particle Devices. *Sol. Energy Mater. Sol. Cells* 143, 613-622 (2015).
16. Ahmad, F., Jamil, M. & Jeon, Y. J. Current Trends in Studies on Reverse-Mode Polymer Dispersed Liquid-Crystal Films—a Review. *Electron. Mater. Lett.* 10, 679-692 (2014).
17. Granqvist, C. G. Transparent Conductors as Solar Energy Materials: A Panoramic Review. *Sol. Energy Mater. Sol. Cells* 91, 1529-1598 (2007).
18. Vergaz, R., Sanchez-Pena, J. M., Barrios, D., Vazquez, C. & Contreras-Lallana, P. Modelling and Electro-Optical Testing of Suspended Particle Devices. *Sol. Energy Mater. Sol. Cells* 92, 1483-1487 (2008).
19. Li, B., Zhou, D. & Han, Y. L. Assembly and Phase Transitions of Colloidal Crystals. *Nat. Rev. Mater.* 1 (2016).
20. Ge, D. T., Lee, E., Yang, L. L., Cho, Y. G., Li, M., Gianola, D. S. & Yang, S. A Robust Smart Window: Reversibly Switching from High Transparency to Angle-Independent Structural Color Display. *Adv. Mater.* 27, 2489-2495 (2015).
21. Chen, D. Y., Yoon, J., Chandra, D., Crosby, A. J. & Hayward, R. C. Stimuli-Responsive Buckling Mechanics of Polymer Films. *J. Polym. Sci. B* 52, 1441-1461 (2014).
22. Hu, N. & Burgueno, R. Buckling-Induced Smart Applications: Recent Advances and Trends. *Smart Mater. Struct.* 24 (2015).
23. Khang, D. Y., Rogers, J. A. & Lee, H. H. Mechanical Buckling: Mechanics, Metrology, and Stretchable Electronics. *Adv. Funct. Mater.* 19, 1526-1536 (2009).
24. Singamaneni, S. & Tsukruk, V. V. Buckling Instabilities in Periodic Composite Polymeric Materials. *Soft Matter* 6, 5681-5692 (2010).
25. Huntington, M. D., Engel, C. J., Hryn, A. J. & Odom, T. W. Polymer Nanowrinkles with Continuously Tunable Wavelengths. *ACS Appl. Mater. Interface* 5, 6438-6442 (2013).
26. Genzer, J. & Groenewold, J. Soft Matter with Hard Skin: From Skin Wrinkles to Templating and Material Characterization. *Soft Matter* 2, 310-323 (2006).
27. Bowden, N., Brittain, S., Evans, A. G., Hutchinson, J. W. & Whitesides, G. M. Spontaneous Formation of Ordered Structures in Thin Films of Metals Supported on an Elastomeric Polymer. *Nature* 393, 146-149 (1998).
28. Li, B., Cao, Y. P., Feng, X. Q. & Gao, H. J. Mechanics of Morphological Instabilities and Surface Wrinkling in Soft Materials: A Review. *Soft Matter* 8, 5728-5745 (2012).
29. Kim, P., Hu, Y. H., Alvarenga, J., Kolle, M., Suo, Z. G. & Aizenberg, J. Rational Design of Mechano-Responsive Optical Materials by Fine Tuning the Evolution of Strain-Dependent Wrinkling Patterns. *Adv. Opt. Mater.* 1, 381-388 (2013).
30. Wu, G. X., Cho, Y., Choi, I. S., Ge, D. T., Li, J., Han, H. N., Lubensky, T. & Yang, S. Directing the Deformation Paths of Soft Metamaterials with Prescribed Asymmetric Units. *Adv. Mater.* 27, 2747-+(2015).
31. Huntington, M. D., Engel, C. J. & Odom, T. W. Controlling the Orientation of Nanowrinkles and Nanofolds by Patterning Strain in a Thin Skin Layer on a Polymer Substrate. *Angew. Chem. Int. Ed.* 53, 8117-8121 (2014).
32. Lee, W. K., Engel, C. J., Huntington, M. D., Hu, J. T. & Odom, T. W. Controlled Three-Dimensional Hierarchical Structuring by Memory-Based, Sequential Wrinkling. *Nano Lett.* 15, 5624-5629 (2015).
33. Stafford, C. M., Harrison, C., Beers, K. L., Karim, A., Amis, E. J., Vanlandingham, M. R., Kim, H. C., Volksen, W., Miller, R. D. & Simonyi, E. E. A Buckling-Based Metrology for Measuring the Elastic Moduli of Polymeric Thin Films. *Nat. Mater.* 3, 545-550 (2004).
34. Askar, K., Leo, S. Y., Xu, C., Liu, D. & Jiang, P. Rapid Electrostatics-Assisted Layer-by-Layer Assembly of near-Infrared Active Colloidal Photonic Crystals. *J. Colloid Interf. Sci.* 482, 89-94 (2016).
35. Monette, L., Anderson, M. P., Wagner, H. D. & Mueller, R. R. The Young's Modulus of Silica Beads/Epoxy Composites: Experiments and Simulations. *J. Appl. Phys.* 75, 1442-1455 (1994).
36. Johnston, I. D., McCluskey, D. K., Tan, C. K. L. & Tracey, M. C. Mechanical Characterization of Bulk Sylgard 184 for Microfluidics and Microengineering. *J. Micromech. Microeng.* 24 (2014).

37. Askar, K., Phillips, B. M., Dou, X., Lopez, J., Smith, C., Jiang, B. & Jiang, P. Self-Assembled Nanoparticle Antiglare Coatings. *Opt. Lett.* 37, 4217 (2012).
38. Yang, H. T., Dou, X., Fang, Y. & Jiang, P. Self-Assembled Biomimetic Superhydrophobic Hierarchical Arrays. *J. Colloid Interf. Sci.* 405, 51-57 (2013).
39. Jiang, P., Bertone, J. F., Hwang, K. S. & Colvin, V. L. Single-Crystal Colloidal Multilayers of Controlled Thickness. *Chem. Mater.* 11, 2132-2140 (1999).
40. Vlasov, Y. A., Bo, X. Z., Sturm, J. C. & Norris, D. J. On-Chip Natural Assembly of Silicon Photonic Bandgap Crystals. *Nature* 414, 289-293 (2001).
41. Wong, S., Kitaev, V. & Ozin, G. A. Colloidal Crystal Films: Advances in Universality and Perfection. *J. Am. Chem. Soc.* 125, 15589-15598 (2003).

As used herein, disjunctive language, such as the phrase "at least one of X, Y, or Z," unless specifically stated otherwise, is otherwise understood with the context as used in general to present that an item, term, etc., can be either X, Y, or Z, or any combination thereof (e.g., X, Y, and/or Z). Thus, such disjunctive language does not imply that certain embodiments require at least one of X, at least one of Y, or at least one of Z to each be present.

It should be noted that ratios, concentrations, amounts, and other numerical data may be expressed herein in a range format. It is to be understood that such a range format is used for convenience and brevity, and thus, should be interpreted in a flexible manner to include not only the numerical values explicitly recited as the limits of the range, but also to include all the individual numerical values or sub-ranges encompassed within that range as if each numerical value and sub-range is explicitly recited. To illustrate, a concentration range of "about 0.1% to about 5%" should be interpreted to include not only the explicitly recited concentration of about 0.1 wt % to about 5 wt %, but also include individual concentrations (e.g., 1%, 2%, 3%, and 4%) and the sub-ranges (e.g., 0.5%, 1.1%, 2.2%, 3.3%, and 4.4%) within the indicated range. In an embodiment, the term "about" can include traditional rounding according to the values and/or measuring techniques. In addition, the phrase "about 'x' to 'y'" includes "about 'x' to about 'y'".

Many variations and modifications may be made to the above-described embodiments. All such modifications and variations are intended to be included herein within the scope of this disclosure and protected by the following claims.

It is understood that the above-described embodiments of the present disclosure are merely possible examples of implementations set forth for a clear understanding of the principles of the disclosure. Many variations and modifications can be made to the above-described embodiment(s) without departing substantially from the spirit and principles of the disclosure. All such modifications and variations are intended to be included herein within the scope of this disclosure and protected by the following claims.

We claim:

1. A structure, comprising:

a composite film comprising particles and an elastomer matrix, wherein the particles and the elastomer matrix form a particle layer being a top portion of the composite film, wherein the composite film is configured to modify in response to a force applied to alter the planar configuration of at least a portion of the composite film;

wherein the composite film appears opaque when the force is applied to modify the composite film toward the particle layer; and wherein the composite film appears transparent when the force is applied to modify the composite film away from the particle layer.

2. The structure of claim 1, wherein the particle is selected from the group consisting of: a silica particle, a porous silicon particle, a $TiO_2$ particle, a zinc oxide particle, an epoxy resin particle, a silica plate, a porous silica plate, a $TiO_2$ plate, a zinc oxide plate, an epoxy resin plate, a nanoclay, gibbsite particle, Janus nanoparticle, a glass fiber, a silica wire, silica tube, graphene, and a combination thereof.

3. The structure of claim 1, wherein modification comprises at least one of buckling or bending of the structure.

4. The structure of claim 1, wherein the force is a mechanical force, wherein the mechanical force is applied by hands, machines, actuators, or a mechanism configured to apply the mechanical force.

5. A structure, comprising:

a composite film comprising particles and an elastomer matrix, wherein the particles and the elastomer matrix form a particle layer being a top portion of the composite film, wherein the composite film is configured to modify in response to a force applied to alter the planar configuration of at least a portion of the composite film;

wherein the composite film appears opaque when the force is applied to modify the composite film toward the particle layer;

wherein the composite film appears transparent when the force is applied to modify the composite film away from the particle layer; and wherein the mechanical force applied is greater than 0.01 Newtons.

6. The structure of claim 1, wherein the thickness of the composite film is in the range of about 1000 nanometers to about 50 millimeters.

7. The structure of claim 4, wherein the mechanical force is applied to the composite film at a single point on the composite film.

8. The structure of claim 4, wherein the mechanical force is applied at more than one end of the composite film.

9. The structure of claim 4, wherein the mechanical force is applied at a point of the planar surface of the composite film.

10. The structure of claim 1, wherein the elastomer matrix is a polymer selected from the group consisting of: polydimethylsiloxane, polyethylene terephthalate, polyesters, polyacrylates, silicone rubber, polypropylene oxide rubber, and a combination thereof.

11. A structure, comprising:

a composite film comprising particles and an elastomer matrix, wherein the particles and the elastomer matrix form a particle layer that is on a top portion of the composite film, wherein the composite film is configured to bend in response to a force, wherein bending the composite film toward the particle layer causes the composite film to appear opaque, and wherein bending the composite film away from the particle layer causes the composite film to appear transparent.

12. The structure of claim 11, wherein the particle is selected from the group consisting of: a silica particle, a porous silicon particle, a $TiO_2$ particle, a zinc oxide particle, an epoxy resin particle, a silica plate, a porous silica plate, a $TiO_2$ plate, a zinc oxide plate, an epoxy resin plate, a nanoclay, gibbsite particle, Janus nanoparticle, a glass fiber, a silica wire, silica tube, graphene, and a combination thereof.

13. The structure of claim 11, wherein the mechanical force is applied at a point of the planar surface of the composite film and wherein the mechanical force is applied over the edges of the composite films.

14. The structure of claim 11, wherein a volume fraction of the particles in the particle layer can be about 40 to 85%.

15. The structure of claim 11, wherein the elastomer matrix is a polymer selected from the group consisting of: polydimethylsiloxane, polyethylene terephthalate, polyesters, polyacrylates, silicone rubber, polypropylene oxide rubber, and a combination thereof.

* * * * *